United States Patent [19]

Novosel

[11] Patent Number: 5,026,064

[45] Date of Patent: Jun. 25, 1991

[54] GOLF CLUB SWING TRAINING DEVICE

[76] Inventor: John M. Novosel, 12708 Pembroke La., Leawood, Kans. 66209

[21] Appl. No.: 307,001

[22] Filed: Feb. 6, 1989

[51] Int. Cl.[5] ..... A63B 69/36

[52] U.S. Cl. ..... 273/186 E; 273/DIG. 30

[58] Field of Search ..... 273/186 E, 199 R, 183 D, 273/DIG. 30, 183 C, 193 R, 193 A, 194 A, 194 B, 186 R, 186 A

[56] References Cited

U.S. PATENT DOCUMENTS 3,401,941 9/1968 Heisdence ..... 273/186 E 4,149,726 4/1979 Tredway ..... 273/186 E

*Primary Examiner*—George J. Marlo

*Attorney, Agent, or Firm*—Thomas M. Scofield

[57] ABSTRACT

A golf club shaft is provided with a training head that, when the club is swung, strikes a movable, upright target composed of a yieldable, light-weight material. The target presents a relatively broad, laterally facing target surface and, when struck, becomes attached to the head and is carried thereby through the remainder of the swing. The addition of the target to the head provides increased resistance to train the player to increase club head speed at impact and beyond. The training head provides visual feedback at the finish so that the player will know whether a proper swing was executed.

15 Claims, 3 Drawing Sheets

GOLF CLUB SWING TRAINING DEVICE

This invention relates to an improved method and apparatus for training the movements of the body to properly execute a golf swing and, in particular, to a method and apparatus which enables the golfer to simulate a full golf swing with natural relaxation and increased velocity of the club head at impact and beyond, ending in a balanced finish, and which provides observable feedback to the player.

In the game of golf a player knows that he or she has swung the golf club correctly if the body at the finish of the swing is in proper position. Ideally, for a right-handed player, at the finish most of the weight is balanced on the left foot, the right heel is raised so that the player is also balanced on the right toe, the body (stomach and hips) is facing the target, and the arms and hands are in a position such that the club shaft extends generally over the left shoulder and across the back with the club head directly above the spot on the playing surface where the ball originally lay.

Achieving this ideal finish, however, is very difficult for most golfers. Conventional instructional approaches tend to emphasize the individual elements of the golf swing rather than the overall objective. Various types of mechanical apparatus have been proposed heretofore to train the path of the swing, but these devices generally encumber the player rather than permit him to move freely and swing the club in a natural manner.

It is, therefore, the primary object of the present invention to provide a method and apparatus for training a golfer to properly execute a full golf swing, which advantageously promotes the use of the player's natural instincts and allows the player to move and swing freely unencumbered by any restraints.

As a corollary to the foregoing object, it is an important aim of this invention to provide such a method and apparatus which simulates hitting the ball by striking a movable target which then adheres to the training head of the practice club to provide desired resistance at impact and thereafter through to the finish of the swing.

Another important object of the present invention is to provide a target as aforesaid which is yieldable and lightweight and which presents a relatively large target surface that the player strikes with the head of the training club, thereby encouraging the player to relax due to the size of the target (as compared to a golf ball) and the absence of any special requirements other than to naturally strike it.

Still another important object of the invention is to provide a club provided with a training head having a ball-like configuration and presenting opposed, toe and heel portions, the heel having identifying indicia thereon for providing visual feedback to the player at the finish of the swing.

Yet another important object of the invention is to provide such a ball-like training head which presents a curved face for striking the target surface, both the face and the target surface being at least partially covered with materials which adhere to each other such as mating Velcro fabrics.

Other objects will become apparent as the specification proceeds.

DETAILED DESCRIPTION

Figure 5:
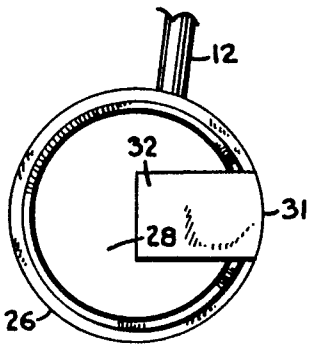
FIG. 5 is an elevational view of the training head taken along line 5—5 of FIG. 4, looking directly at the toe of the head.

Referring initially to FIGS. 1–6, a training club 10 of the present invention has the usual elongated shaft 12 which, at the upper end thereof, is provided with a handle 14 adapted to be grasped by the player in the normal manner. The particular training club 10 illustrated is provided with a reminder grip so that the player, regardless of his or her degree of skill, will properly grasp the handle 14 in the fingers and palm of the left hand and the fingers of the right hand. The lower end of the shaft 12 is provided with a training head 16 in the form of a solid ball as revealed in FIGS. 4–6. Typically, the length of the shaft 12 would be somewhat less than the length of a comparable golf club because the training head 16, as will be discussed hereinbelow, is designed to be held above the playing surface rather than to lie directly thereon as is the case with a playing club.

A light-weight, movable target 18 rests on the ground or other playing surface and includes a base 20, a pair of laterally-spaced, tubular pillars 22, and a sheet of fabric or other flexible material 23 spanning the pillars 22 and, on the front side of the target (seen in FIG. 1), presenting a target surface 24 for receiving the impact of the training head 16 when the club is swung. The entire target 18 is composed of yieldable material and is not affixed to the ground, as will become apparent.

It should be particularly noted that the target surface 24 extends upwardly from the base 20, the latter resting on the ground or other playing surface. Furthermore, as is clear in FIG. 1, the target surface 24 also extends front-to-rear relative to the player addressing it in order to present a relatively broad, laterally facing target area to be struck with the training head 16. As compared to the size of a golf ball, the components 16 and 24 (head and target surface) are purposely relatively large; for example, the preferred outside diameter of the head 16 is approximately three inches (7.6 cm.). Accordingly, the relatively large target is easy to hit using a relaxed swing so the player in using the apparatus does not have to concentrate on a small target of golf ball size.

To minimize weight and promote response to impact, the pillars 22 may be composed of tubular, foam material as illustrated and serve simply to maintain the target surface 24 in an upright position, preferably tilted away from the training head 16 at an angle of approximately ten degrees. As will be discussed hereinafter, the region bounded by the target surface 24 and the base 20 defines a strike zone, the base 20 presenting an apron to facilitate alignment of the head 16 with the target surface 24 when addressed by the player.

Figure 4:
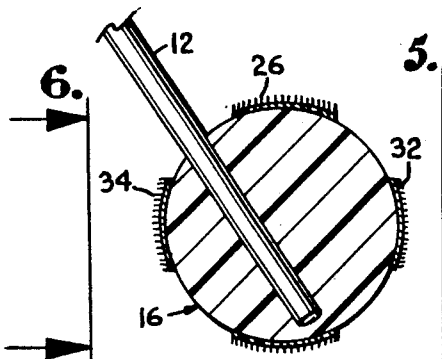
FIG. 4 is a vertical cross-section through the head of the training club taken along line 4—4 of FIG. 1, showing the head and the lower end of the shaft fragmentarily on an enlarged scale.
Figure 2:
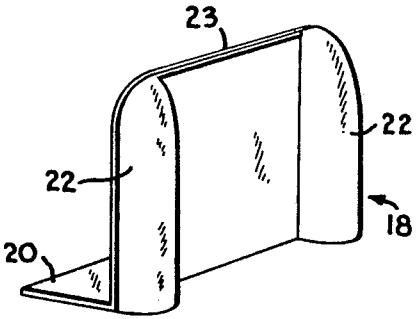
FIG. 2 is a rear perspective view of the target alone.
Figure 1:
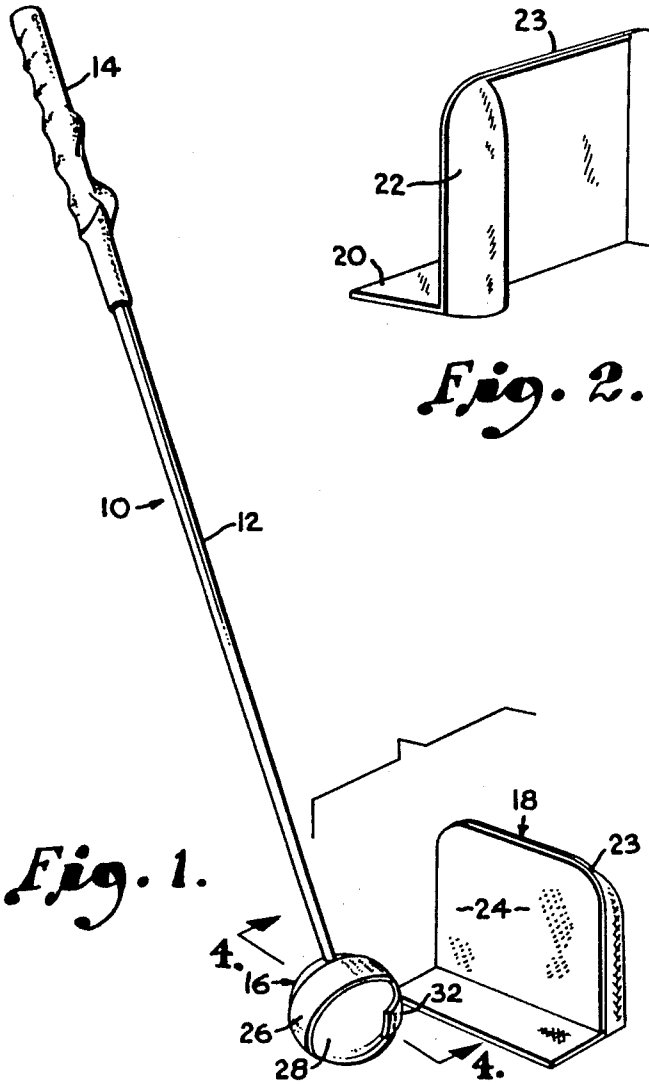
FIG. 1 is a frontal perspective view of a training club and target in accordance with the present invention.

The lower end of the shaft 12 is embedded in the head or ball 16 as is clear in FIG. 4. A strip of Velcro material 26 circumscribes the head 16 and lies generally in the vertical plane of the intended flight of a golf ball, if the same were present. The Velcro strip 26 is secured to the surface of the head 16 by adhesive or other suitable means. At right angles to the circumscribing strip 26, the head 16 presents opposed toe and heel portions 28 and 30 respectively.

Figure 6:
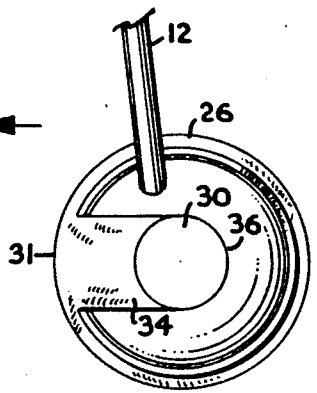
FIG. 6 is an elevational view of the training head taken along line 6—6 of FIG. 4, looking directly at the heel of the head.
Figure 3:
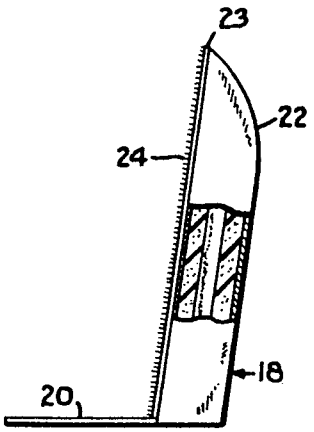
FIG. 3 is a side view of the target on an enlarged scale as compared with FIGS. 1 and 2, with parts broken away to reveal details of construction.

The center of a striking face is defined by the intersection 31 of the Velcro strip 26 and Velcro elements 32 and 34 as best seen by a comparison of FIGS. 5 and 6. Velcro element 32 extends from intersection 31 to the toe 28 of the head 16, and Velcro element 34 extends from the intersection 31 to the heel 30 thereof. The sheet 23 of the target 18 is covered with a mating Velcro material to present the target surface 24 and provide the target with the ability to stick firmly to the face of the head 16 upon contact.

It should also be noted, as revealed in FIG. 6, that the heel 30 of the head 16 has a circular spot 36 thereon for visual identification. Spot 36 should be of a contrasting color so that it can be readily seen by the player at the finish of the swing, as will be appreciated hereinafter.

Figure 7:
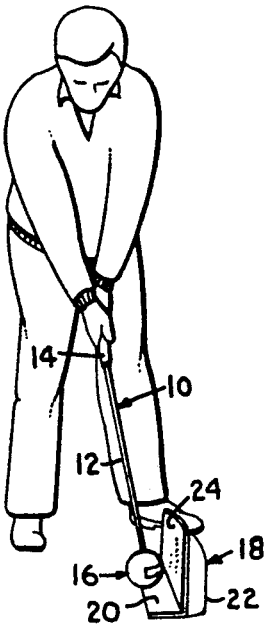
FIGS. 7–11 are progressive views illustrating the use of the training club and target by a player and the practice of the method of the present invention.
Figure 8:
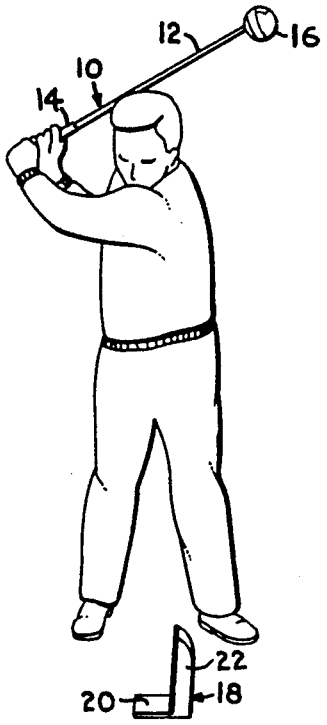
Figure 9:
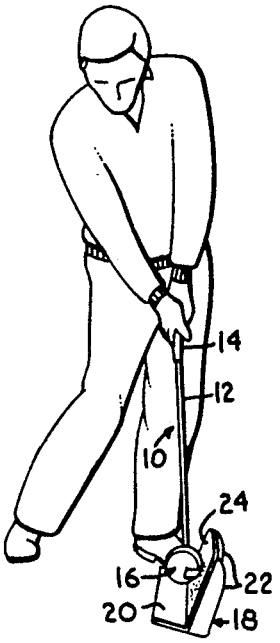

Practice with the training club 10 and the target 18 of the present invention is illustrated by the sequence of views of FIGS. 7–11. In FIG. 7 the player is addressing the target. The head 16 is not grounded on the playing surface but is held thereabove in approximate alignment with the center of the target surface 24. FIG. 8 shows the player at the top of his backswing; FIG. 9 shows the strike, i.e., the instant of impact of the head 16 with the target 18. Upon impact, the Velcro material on the face of the head 16 is brought into contact with the Velcro facing on the target surface 24 thereby causing the target to become instantly attached to the head.

Figure 10:
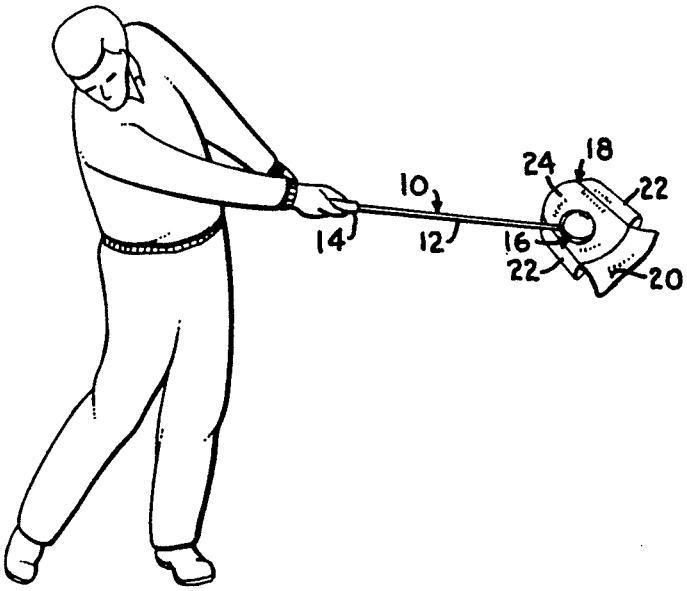

Once the target 18 is united with the head at the strike, it is carried with the head throughout the remainder of the swing. Accordingly, both air and weight resistance is added at impact and beyond to the finish of the movement. This is illustrated in FIG. 10 where the player is shown during the follow-through, and in FIG. 11 where the player is shown at the finish of the swing. Due to its collapsible nature, the target 18 essentially envelopes the head 16 at the finish as shown in FIG. 11 where the target is illustrated in broken lines.

Besides providing a relaxed environment for practice as discussed above, the target by adding resistance at impact and beyond also serves to increase club head speed at impact and during the follow-through in actual play when, of course, the player is swinging a golf club and the target is no longer present. This trains the golfer that the correct place for an increase in club head speed is at impact and beyond, not at the top of the swing prior to impact.

Figure 11:
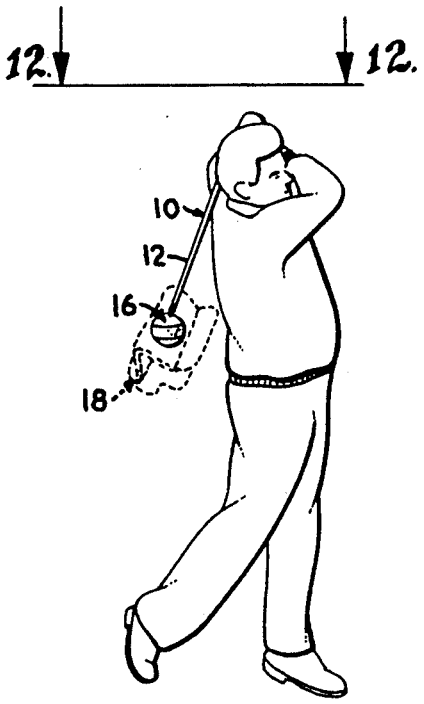
Figure 12:
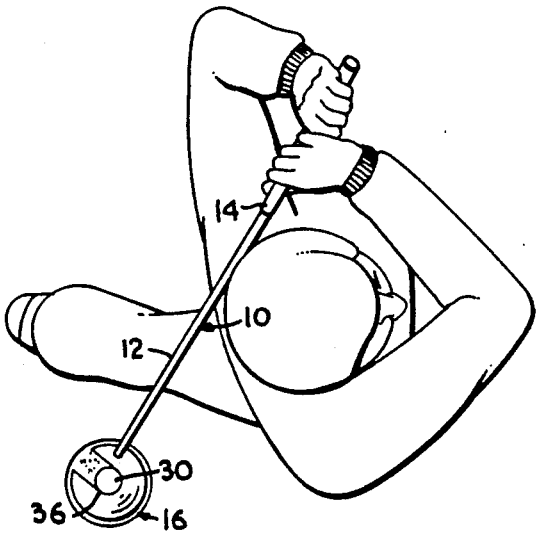
FIG. 12 is a plan view taken along line 12—12 of FIG. 11, looking downwardly on the player and showing his position at the finish of the swing.
Figure 13:
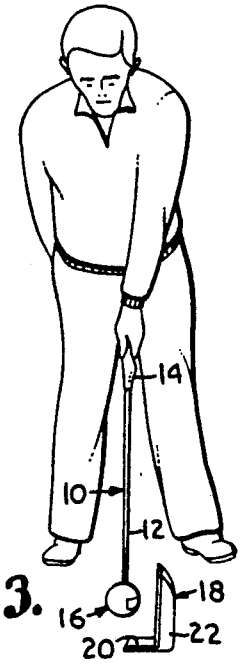
FIGS. 13–16 are progressive views illustrating the use of the present invention to perfect the swing with the left arm alone.

FIG. 12 shows the visual feedback provided by the spot 36 on the head 16. In a proper finish the spot 36 will present the top of the head 16 as shown and will be clearly visible to the player. Also, additional feedback at the finish is provided by the present invention as follows:

(1) As shown in FIG. 11, the target will have stuck on the head with its back side facing opposite to the direction of aim;

(2) The head and the attached target will have arrived at a position generally over the strike zone;

(3) The player will have finished in balance as described above, with the stomach and hips facing the direction of aim; and (4) When the player removes the target from the head, he will see from the mating areas of adhesion whether the face of the head struck the target surface squarely or was open or closed.

Figure 14:
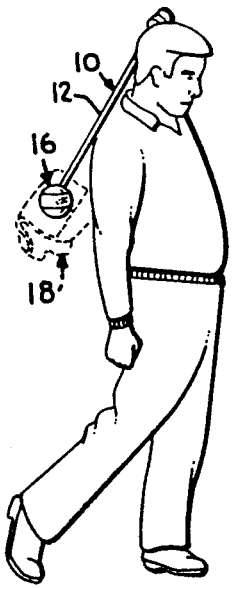
Figure 15:
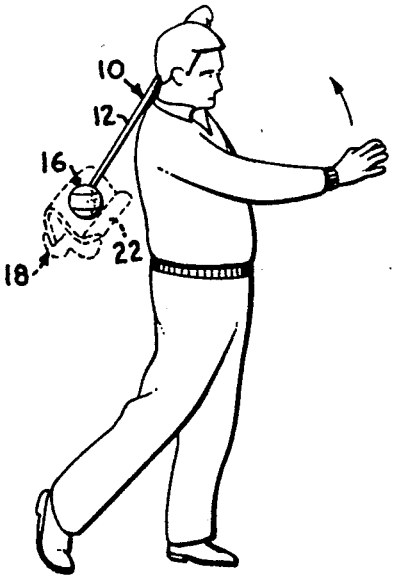
Figure 16:
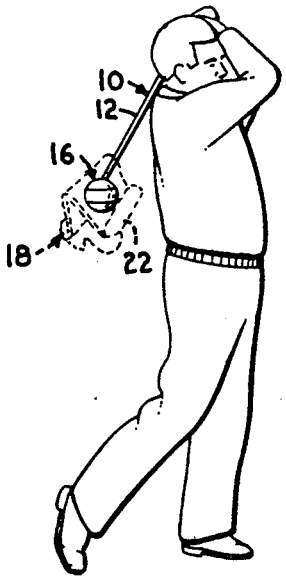

FIGS. 13–16 are progressive views similar to FIGS. 7–11, but illustrate practice with the left arm only. The target as addressed as before (FIG. 13) and a full swing is taken through to the finish (FIG. 14). Then, as illustrated in FIGS. 15 and 16, the right hand is brought up to the left hand to complete the proper positioning of the body at the finish. This exercise strengthens the left arm and may be employed in similar fashion for the right arm only. Preferably, a somewhat smaller target 18 would be employed to reduce the resistance when practicing the swing with one arm.

Having thus described the invention, what is claimed as new and desired to be secured by Letters Patent is:

1. A golf training device comprising:

an elongate shaft having a pair of opposed ends, one of said ends being provided with a handle adapted to be grasped by a suer to swing the shaft in a golfing stroke;

a training head of a size greater than a wood golf club head on the other of said ends of the shaft presenting a striking face larger than the striking face of a wood golf club head on a portion thereof for said golfing stroke;

a movable, normally upright target of an overall target presenting area substantially greater in size than the striking face of said head positionable on the ground at a strike zone where a golf ball could otherwise lie when addressed by the said user;

means on at least a portion of said training head striking face and at least a portion of said target presenting area for releasably uniting the same for movement together upon impact of the two through the remaining part of the golf swing after the user strikes the target with the striking face of the training head;

said uniting means causing at least a portion of said target presenting area to adhere to the striking face portion of said head with the rest of said target collapsing around said striking face and head upon impact thereby;

said target and presenting area thereof composed of a yieldable, strong, at least somewhat collapsible, yet relatively lightweight material and structure, compared to the weight of said training head, whereby not to seriously impede the continued motion of the training head when said head strikes the target at speed; and the addition of the target upon impact to, collapsing therearound and carriage thereof collapsed by the training head providing sufficient and substantial mass and air resistance at impact and through to the finish of the swing to be clearly perceived as such throughout such latter swing interval by the user, yet not substantially impeding the carrying out of the golfing stroke.

2. The golf training device as claimed in claim 1, wherein said target in said strike zone possesses a relatively broad, relatively high, target presenting area surface, such surface both broader and higher than said training head itself and the striking face thereof, and extending upwardly from the ground or other playing surface for easily and conveniently receiving the impact of the striking face of the training head thereon in the course of a golf stroke.

3. The golf training device as claimed in claim 1, wherein said uniting means on the target and such on said training head striking face cover at least a substantial portion of said target presenting area surface and training head striking face, respectively.

4. The golf training device as claimed in claim 1, wherein said target includes a base adapted to rest upon the ground or other playing surface, which base provides an apron in front of said target aiding the user in aligning the striking face of the training head with the target present area before striking the target.

5. The golf training device as claimed in claim 1, wherein said target includes, as parts thereof, a pair of laterally spaced apart, upstanding pillars of light, strong yet yieldable material and a flexible, light, strong sheet extending between and connecting said pillars and providing and presenting said sheet as said target surface and presenting area to the user.

6. The golf training device as claimed in claim 5 wherein said target includes a base adapted to rest upon the ground or other playing surface which base provides an apron in front of said target aiding in aligning the striking face of the training head with the target before striking the target, the base on the opposite side of the target from said pillars.

7. A device as in claim 1 wherein said target in said strike zone presents a relatively broad, relatively high, laterally facing target surface, such surface both broader and higher than said training head itself in the striking face thereof, and extending upwardly from the ground or other playing surface for easily and conveniently receiving the impact of the striking face of the training head thereon in the course of a golf stroke, said target includes, as parts thereof, a pair of laterally spaced apart, upstanding pillars of light, strong yet yieldable material and a flexible, light, strong sheet extending between and connecting to said pillars and providing and presenting said sheet as said target surface to the user, said target also including a base adapted to rest upon the ground or other playing surface, which base provides an apron in front of said target aiding the user in aligning the striking face of the training head with the target before striking the target.

8. A device as in claim 7 wherein the means on at least a portion of the target for releasably uniting the target for movement with the striking face of the training head is positioned on the same side of the sheet of said target as the base thereof.

9. A device as in claim 8 wherein said pillars are placed on the opposite side of said sheet from said base and said releasably uniting material on said sheet.

10. A device as in claim 8 wherein said releasably uniting means on the target and such on said training striking face cover at least a substantial portion of said target surface and training head striking face, respectively.

11. A device as in claim 1 wherein said training head is substantially spherical and of lesser diameter than the breadth and height of said target surface, said training head being of substantially greater size than a normal wood golf club head.

12. A device as in claim 1 wherein said training head is of a substantially greater size than the size of a wood golf club head.

13. A golf training device comprising:

an elongate shaft having a pair of opposed ends, one of said ends being provided with a handle adapted to be grasped by a user to swing the shaft in a golfing stroke;

a training head on the other of said ends of the shaft presenting a striking face on a portion thereof for said golfing stroke;

a movable, normally upright target positionable on the ground at a strike zone where a golf ball could otherwise lie when addressed by said user;

means on said training head and said target for releasably uniting the same for movement together upon impact of the two through the remaining part of the golf swing after the user strikes the target with the striking face of the training head, whereby the addition of the target to and carriage thereof by the training head provides sufficient and substantial mass and air resistance at impact and through to the finish of the swing to be clearly perceived as such throughout such latter swing interval by the user, yet does not substantially impede the carrying out of the golfing stroke;

said target being composed of a yieldable, strong, at least somewhat collapsible yet relatively lightweight material and structure, compared to the weight of said training head, whereby not to seriously impede the continued motion of the training head when said head strikes the target at speed, said uniting means causing at least a portion of said target to adhere to the striking face portion of said head upon impact thereby;

said target in said strike zone presenting to the user and the striking face of said head a relatively broad, relatively high, laterally facing target surface, such surface both broader and higher than said training head itself and the striking face thereof, and extending upwardly from the ground or other playing surface for easily and conveniently receiving the impact of the striking face of the training head thereon;

said target including a base adapted to rest upon the ground or other playing surface, which base provides an apron in front of said target aiding the user in aligning the striking face of the training head with the target before striking the target; and said target further including, as parts thereof, a pair of laterally spaced apart, upstanding pillars of light, strong, yet yieldable material and a flexible, light, strong sheet extending between and connecting said pillars and providing and presenting said sheet as said target surface to the user.

14. A method of training the movements of the body to more properly execute a golf swing, said method comprising the steps of:

(a) providing an elongate shaft having a pair of opposed ends, one of said ends being provided with a handle adapted to be grasped by a user to swing the shaft in a golfing stroke;

(b) providing an enlarged training head on the other of said ends of the shaft which presents a striking face on a portion thereof for said golfing stroke;

(c) positioning a movable, normally upright target larger in area than the size of the striking head on the ground at a strike zone where a golf ball could otherwise lie when addressed by the said user;

(d) there being means on at least a portion of said training head striking face and at least a portion of said target for releasably uniting the same for movement together upon impact of the two through the remaining part of the golf swing after the user strikes the target with the striking face of the training head;

(e) the user grasping the handle of the shaft and addressing the target with the striking face of the training head;

(f) the user then drawing back the shaft and training head in the initial, preparatory part of a golf stroke, whereby to thereafter execute a golf stroke wherein the target is struck with the striking face portion of the head;

(g) said target composed of a yieldable, strong, at least somewhat collapsible yet relatively light weight material and structure, compared to the weight of said training head, whereby not to seriously impede the continued motion of the training head when said head strikes the target at speed, said uniting means causing at least a portion of said target to adhere to the striking face portion of said head upon impact thereby;

(h) the addition of the target upon impact to and carriage thereof by the training head providing sufficient and substantial mass and air resistance at impact and through to the finish of the swing to be clearly perceived as such throughout such later swing interval by the user, yet not essentially impeding the carrying out of the golfing stroke.

15. A method as in claim 14 wherein the training head is spherical and of a greater size than a wood golf club head and the target in said strike zone presents a relatively broad, relatively high, laterally facing target surface, such surface both broader and higher than said training head outer diameter and the striking face thereof and extending upwardly from the ground or other playing surface for easily and conveniently receiving the impact of the striking face of the training head thereon in the course of the golf stroke.

* * * * *